US005263847A

United States Patent [19]

Akkerman et al.

[11] Patent Number: 5,263,847

[45] Date of Patent: Nov. 23, 1993

[54] SUBSURFACE TUBING SAFETY VALVE

[75] Inventors: Neil H. Akkerman; Thomas R. Buckner, both of Houston, Tex.

[73] Assignee: AVA International Corporation, Houston, Tex.

[21] Appl. No.: 877,828

[22] Filed: May 1, 1992

[51] Int. Cl.[5] ..... E21B 34/10

[52] U.S. Cl. ..... 251/303; 251/63.4; 137/516.29; 166/332

[58] Field of Search ..... 137/516.29, 527; 251/298, 303, 63.4; 116/332

[56] References Cited

U.S. PATENT DOCUMENTS

| | | | |
|---|---|---|---|
| 2,162,578 | 6/1939 | Hacker | 255/72 |
| 4,427,071 | 1/1984 | Carmody | 166/332 |
| 4,433,702 | 2/1984 | Baker | 137/527 |
| 4,457,376 | 7/1984 | Carmody et al. | 166/332 |
| 4,583,596 | 4/1986 | Davis | 166/332 |
| 4,674,575 | 6/1987 | Guess | 166/332 |
| 4,716,968 | 1/1988 | Pringle | 166/332 X |
| 4,834,183 | 5/1989 | Vinzant et al. | 166/332 |
| 5,125,457 | 6/1992 | Meaders | 166/322 |

FOREIGN PATENT DOCUMENTS 2026137 5/1970 Fed. Rep. of Germany .

*Primary Examiner*—John Rivell
*Attorney, Agent, or Firm*—Vaden, Eickenroht, Thompson, Boulware & Feather

[57] ABSTRACT

There is disclosed a subsurface tubing safety valve of the type having a flapper swingable between an open position to one side of its bore and a closed position over a seat about its bore. A seal ring retained in a groove about the seat has a protruding lip which is initially engaged by the flapper as it is swung toward the seating surface of the seat.

4 Claims, 3 Drawing Sheets

FIG. 5
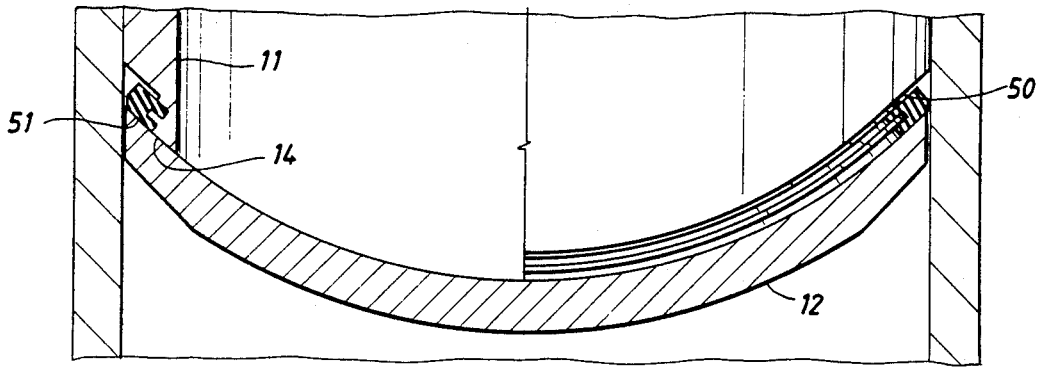
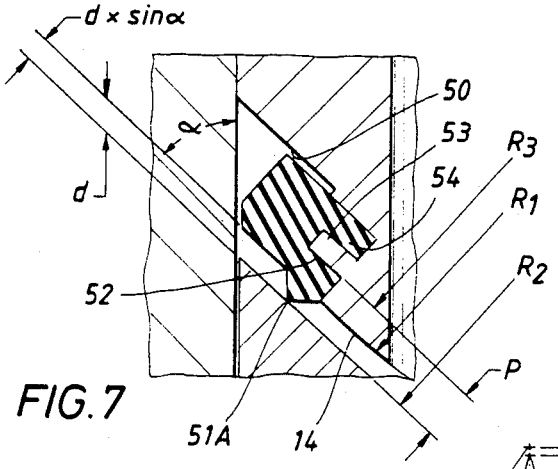
FIG. 7
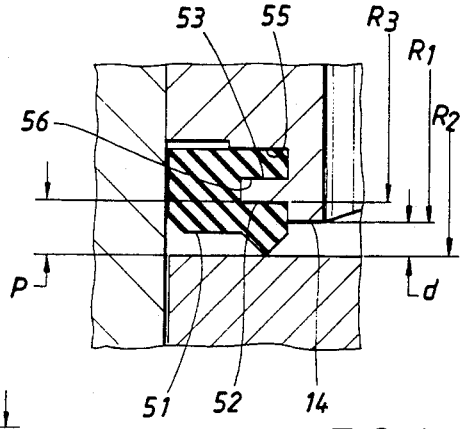
FIG. 8
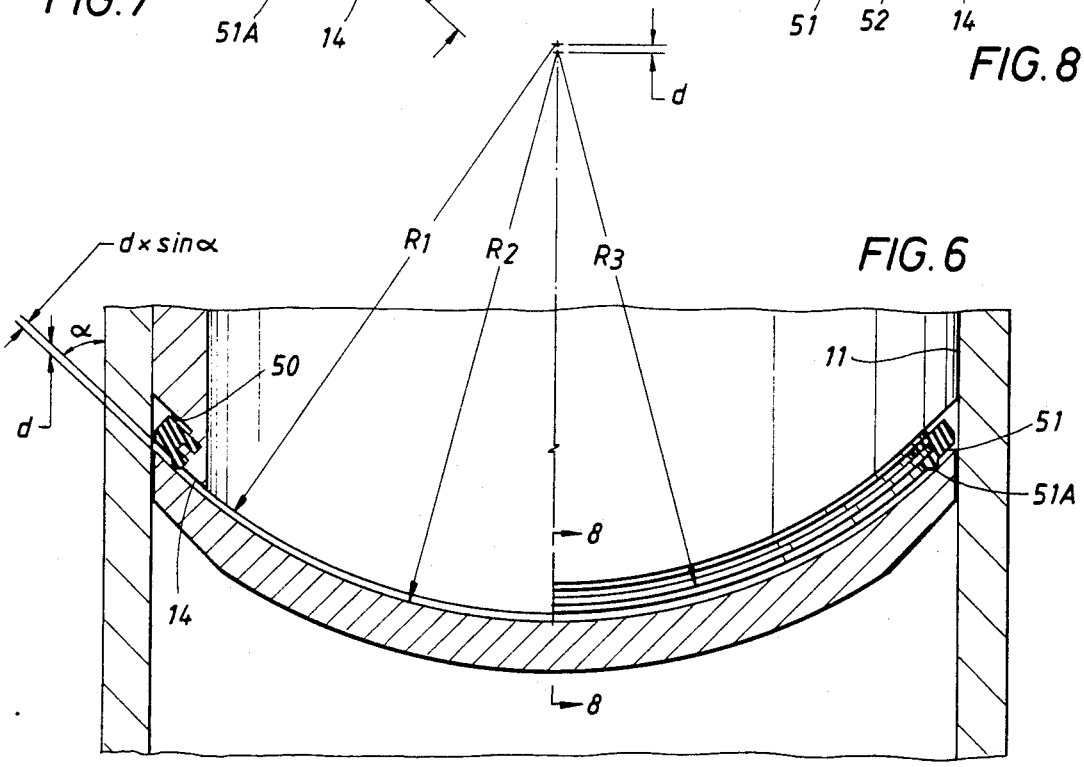
FIG. 6

SUBSURFACE TUBING SAFETY VALVE

This invention relates generally to subsurface tubing safety valves for controlling flow within a tubing string suspended within a well bore and of a type in which a flapper is pivotally mounted within a tubular body disposable within the tubing string for movement from a closed position, in which its upper surface is spring pressed against a seat about the bore, to an open position within a recess to one of the bore. More particularly, this invention relates to improvements in valves of this type in which a seating surface of the seat and a seating surface on the upper side of the flapper are curved about an axis which intersects and is transverse to the axis of the bore so that the flapper may be received within an arcuate recess in the side of the bore in its open position.

Problems have been encountered, in valves of this general type, in effecting a fluid-tight, metal-to-metal seal between the seating surface of the flapper and the seat, especially when the pressure differential across the valve is relatively low such that sand or other small particles may hold the surfaces apart. Hence, it is preferred to install a seal ring in a groove within the seat in order to form an elastomeric seal with the seating surface of the flapper. More particularly, the seal ring includes a portion having a lip which protrudes a short distance from the seating surface of the seat to form an initial seal as it is engaged by the seating surface of the flapper as the flapper moves upwardly toward contact with the seat, and then be compressed between the flapper and the seat, and then be compressed between the flapper and seating surface of the seat as the flapper continues to move upwardly into metal-to-metal contact with the seating surface.

However, because of the cylindrically shaped seating surface of the seat, the seal rings of prior valves of this type have been of widely varying overall heights depending on their location about the circumference of the seat. In the event of large temperature fluctuations within a well, especially at the depth of the subsurface valve, the resulting large differences in the thermal expansion and contraction of the elastomeric seal ring, especially in the case of low pressure differential pressure across the valve, could cause the seal to leak.

It is therefore the object of this invention to provide a valve of the type described in which there is less likelihood of a leak across the seal ring in that there is little or no difference in the thermal expansion of the seal ring at different locations about its circumference, and, more particularly, to provide such a valve in which the lip of the seal ring is initially engaged by the flapper throughout its circumference so as to form a seal therewith despite low pressure differential across the flapper.

In the drawings, wherein like reference characters are used throughout to designate like parts:

FIG. 5 is an enlarged cross-sectional view of the lower end of the seat and the flapper, as seen in FIG. 4;

FIG. 6 is another cross-sectional view of the lower end of the seat and flapper similar to FIG. 5 but upon initial contact of the flapper with the lip of the seal ring in the groove of the seat;

FIG. 7 is an enlarged partial cross-sectional view of the seat as shown in FIG. 5, and FIG. 8 is view similar to FIG. 7, but as seen along broken lines 8—8 of FIG. 6.

This and other objects are accomplished, in accordance with the illustrated embodiment of the invention, by a valve of the type described in which a seal ring retained in a groove about the seat of the body has a portion intermediate an inner wall of the groove and its protruding lip which is of essentially constant radial thickness, whereby it will expand and contract substantially uniformly throughout its circumference despite severe fluctuations in temperature. More particularly, and in accordance with the preferred embodiment of the invention, the inner wall of the groove is formed by a cylindrical surface whose axis also intersects and is perpendicular to the axis of the bore but which has a sufficiently smaller radius than the radius of the seating surface of the seat that the lip is initially engaged by the seating surface of the flapper throughout its entire circumference. As shown, the body has a flange extending inwardly from the inner side of the groove to form the inner wall thereof on one side and a recess on the other side, and the seal ring has a recess in the inner side of said portion which fits over the flange in order to retain the ring in the groove.

Figure 1A:
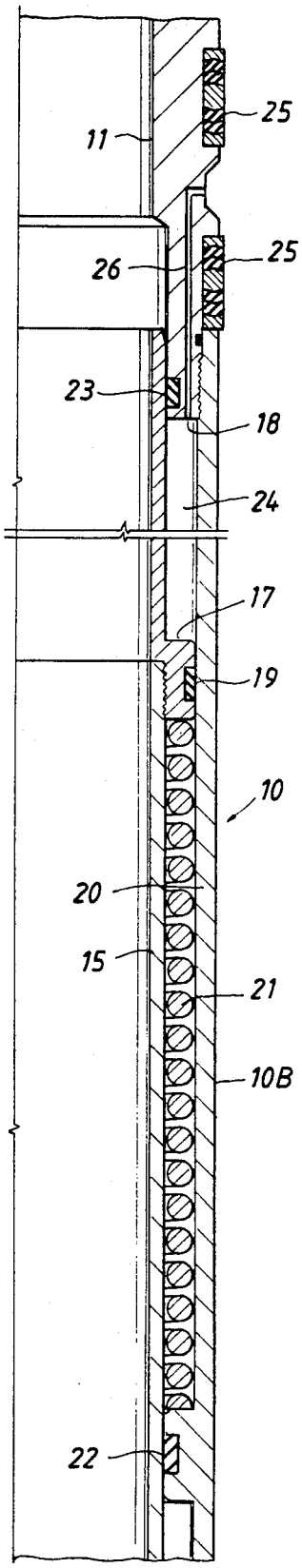
FIG. 1A is a half vertical sectional view and FIG. 1B is a full vertical sectional view of the upper and lower ends, respectively, of a subsurface tubing safety valve constructed in accordance with the present invention and with the flapper to its open position.
Figure 1B:
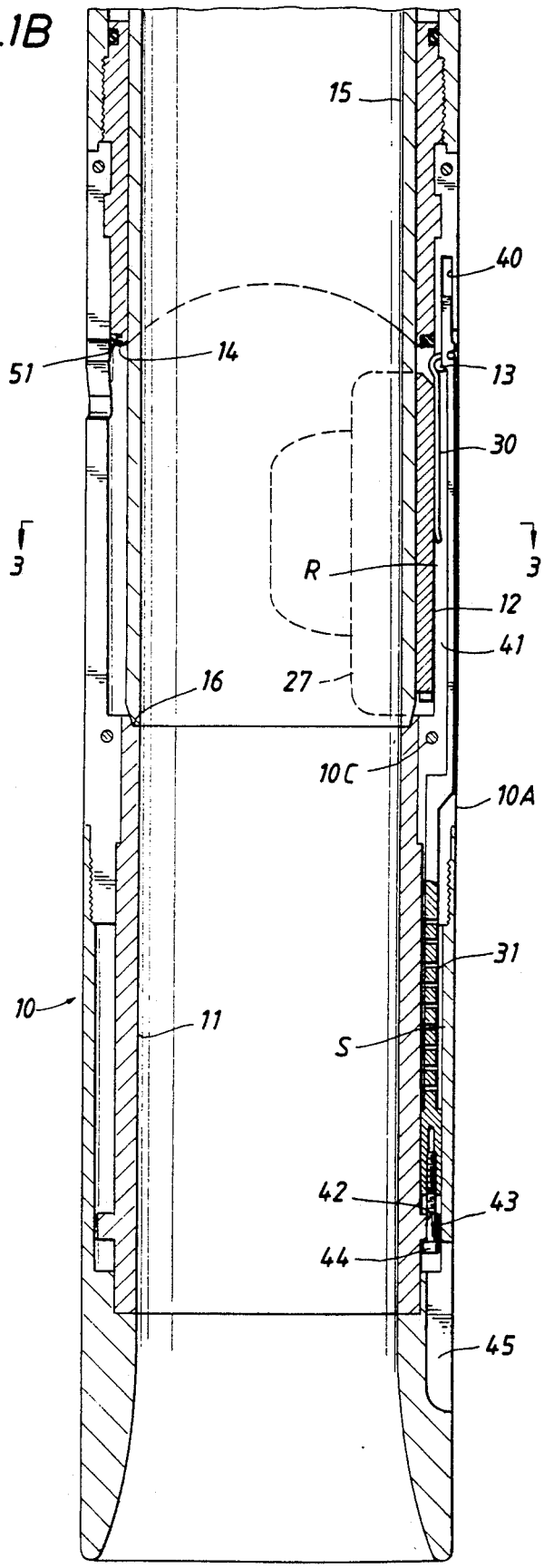

With reference now to the detail of the above-described drawings, the sub-surface safety valve shown in its entirety in FIGS. 1A and 1B is of the wireline retrievable type having a tubular body 10 which is removably mountable within a tubing string adapted to be suspended within a well bore and which has a bore 11 therethrough which forms a continuation of the flowway through the tubing string when so connected. The valve also includes a flapper 12 which is pivotally mounted about pins 13 carried by the body outwardly of the bore for swinging between a position within a recess R in one side of the bore beneath the seat to open the valve, as shown in FIG. 1B, and the position of FIG. 2 wherein it engages a downwardly facing seat 14 about the bore in order to close the valve.

In a manner well known in the art, suitable parts are provided on the body and within the bore of the tubing string for releasably locking it in landed position therein. The invention contemplates, however, that the valve may instead be a tubing mounted type in which its body is connected as part of the tubing string, but in any case, disposable therein during operation of the valve.

The flapper is yieldably urged to its closed position in a manner which will be described in more detail to follow, and, in the illustrated embodiment of the invention, is adapted to be moved to its open position by means of a flow tube 15 vertically reciprocable within the body and forming a continuation of its bore 11. Thus, as the flow tube is lowered from its position of FIG. 2, in which its lower edge is above the flapper to permit it to close, to engage the upper surface of the flapper to swing it downwardly and outwardly to its open position in the recess. On the other hand, when the flow tube is raised to its upper position, in a manner to be described to follow, it permits the flapper to be swung back to its fully closed position of FIG. 2.

When the flow tube is moved downwardly past the flapper, its lower end engages an upwardly facing shoulder 16 about the bore. When the flow tube is moved upwardly to permit the flapper to close, an upwardly facing shoulder 17 thereabout engages a downwardly facing shoulder 18 of the body to limit further upward movement of the flow tube.

More particularly, the shoulder 17 is formed on the upper end of a piston 19 about the flow tube which is sealably slidable within an enlarged inner diameter portion 20 of the body, and the flow tube is yieldably urged to its upper position by means of an elongate coil spring 21 disposed within an annular space about and compressed axially between the lower end of the piston 19 and the upper end of a reduced portion of the body having a bearing 22 which surrounds the flow tube.

The upper end of the flow tube is sealably slidable within an upper reduced diameter portion 23 of the body to form an annular pressure chamber 24 between the shoulders 17 and 18. The flow tube is adapted to be moved downwardly in order to open the valve by the supply of fluid pressure to the pressure chamber. For this purpose, the packing 25 is carried about the body above and below the upper end of a passageway 26 in the valve body connecting at its ulower end with the pressure chamber 24. When the body of the valve is landed in the tubing string, the upper end of passageway 26 connects with the lower end of a tube (not shown) which extends downwardly along the outside of the tubing from a pressurized source of hydraulic fluid at the well head. Of course, upon the exhaust of such source, the coil spring 21 raises the flow tube to permit the flapper to close.

As previously described, and as shown in the drawings, the seat 14 in the bore of the body has a seating surface 14A which is curved about an axis intersecting and perpendicular to the axis of the bore, and the upper surface of the flapper has a seating surface 12A which is similarly curved to conform with the seat in its closed position. More particularly, and as illustrated in FIG. 3, both the upper and lower surfaces of the flapper are curved to a radius substantially equal to but somewhat larger than the radius of the bore through the body so that, when the flapper is moved into the recess, its upper surface is aligned with the bore and thus, of course, with the outer diameter of the flow tube.

Figure 3:
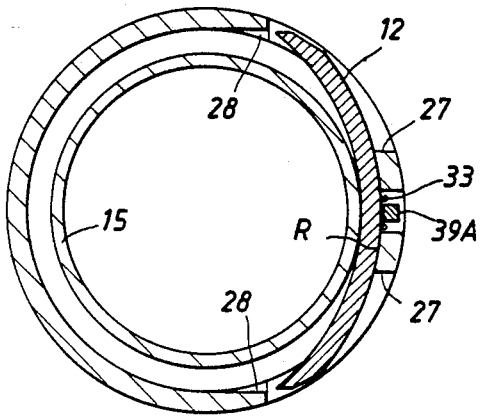
FIG. 3 is a cross-sectional view of the valve, as seen along broken lines 3—3 of FIG. 1B.
Figure 4:
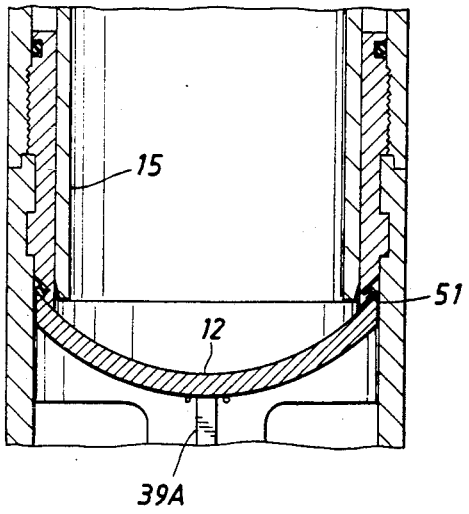
FIG. 4 is a cross-sectional view of the valve, as seen along broken lines 4—4 of FIG. 2.

As shown in FIG. 3, windows 27 are formed in the valve body to accommodate the ends of the flapper in its open position. In addition, the bore of the body is relieved at 28 to receive diametrical portions of the flapper as it is swung between open and closed positions.

The flapper 12 is yieldably urged to its closed position by means which includes an arm 30 pivotally mounted on the body for extension over the lower surface of the flapper, and a spring 31 which is carried within the body intermediate its bore and outer diameter and which acts between the body and the arm to one side of its pivotal axis to provide a vertically extending force to yieldably urge the arm in a direction to swing the flapper toward its closed position.

More particularly, the arm includes an outer hook portion which fits over the pivot pins 13 and an elongate inner end portion which extends over a substantial portion of the lower surface of the flapper. These and other details of the valve thus far described are shown and described in copending application Ser. No. 07/695,275, filed May 3, 1991, and assigned to the assignee of the present application.

Figure 2:
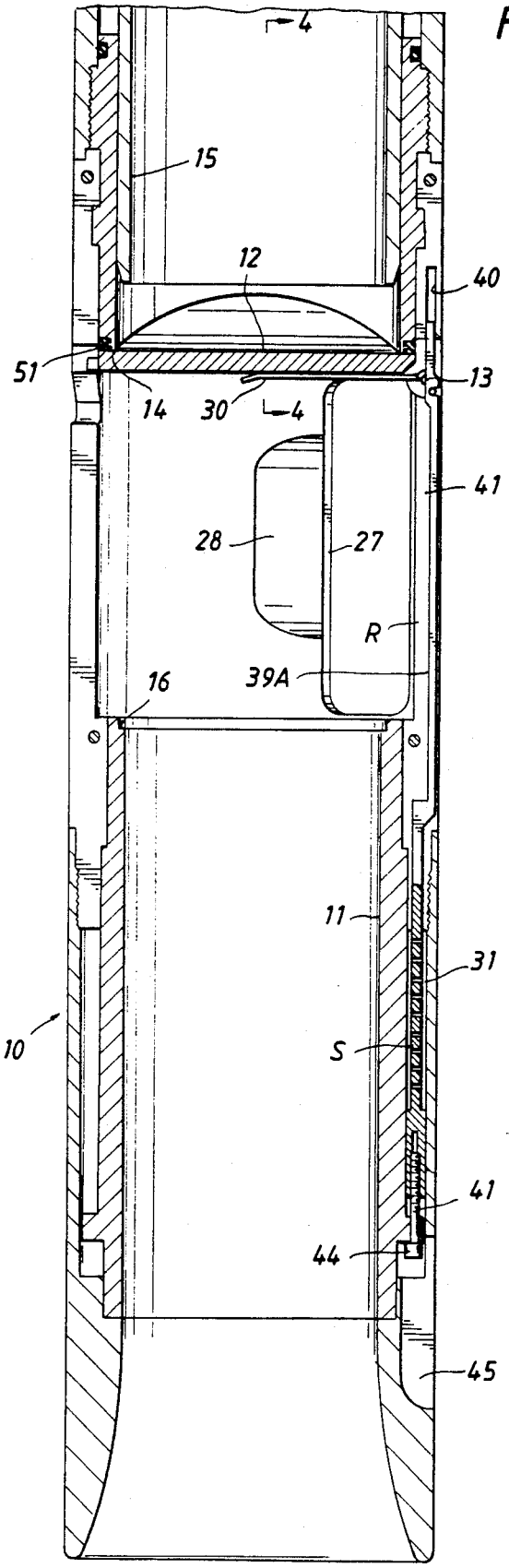
FIG. 2 is a view similar to FIG. 1B, but upon swinging of the flapper to closed position.

The spring also includes an upper elongate portion 39A having an upper end to which the pin 13 is connected and a lower elongate portion 40 which is held at its lower end by means of a threaded bolt 41. As shown in FIGS. 1B and 2, the bolt extends through a hole 42 in a flange 43 of the valve body at the lower end of the annular space S in which the body portion of the spring is received, and has a head 44 at its lower end which bears against the lower side of the flange. Thus, when the bolt is properly made up with the lower end of the spring, it places the spring in tension so as to act upon the end of the arm to swing the arm in a clockwise direction and thus swing the flapper to its closed position. An opening 45 formed in the outer diameter of the tubular body permits access to the head 44 of the bolt to adjust the tension in the spring when the valve is removed from within the tubing string.

The upper portion 39 of the spring has an outwardly recessed portion which, as best shown in FIGS. 1B and 2, conforms to the recess in the bore of the body to accommodate the flapper in its open position. The uppermost end of the upper portion extends upwardly into a slot 46 in the valve body.

As shown, the seat 14 has a groove 50 formed therein outwardly of its seating surface, and a seal ring 51 retained in the seat has a lip 51A which protrudes from the seating surface in position to be engaged by the flapper as the flapper is swung to closed position, and a portion P intermediate the lip and an inner wall 52 of the groove which is compressed between the flapper and inner wall as the flapper moves from the position of FIG. 6 to the fully closed position of FIG. 5. More particularly, and in accordance with the novel aspects of this invention, such portion is of essentially constant radial thickness throughout its circumference, and the groove is so constructed that the the flapper will initially contact the lip 51 at essentially the same time throughout its circumference so as to effect a seal in the FIG. 6 position despite a lower pressure differential across the flapper.

As can be seen from FIG. 6, although the radius $R_1$ of the seating surface of the seat and the radius $R_2$ of the upper side and thus the seating surface of the flapper are equal, their axes are spaced a distance d from one another as the flapper moves into initial contact with lip 51. Thus, as shown, while the seating surface of the seat and the flapper are spaced apart the distance d at locations intermediate the sides of the seat, they are spaced apart only a distance $d \times \sin$ at their opposite sides. Consequently, if the radius $R_3$ of the inner wall 52 of the groove was equal to the radii $R_1$ and $R_2$, the flapper would initially engage only part of the lip of the seal ring—namely, that adjacent its opposite sides as seen in FIG. 6. The resulting gap between the lip and flapper could prevent a seal in the event of a low pressure differential across the flapper.

In order to compensate for this difference, and still maintain the portion P of the seal ring intermediate the inner wall and the lip of equal thickness, the inner wall 52 is formed about a radius $R_3$ which is less than $R_1$ or $R_2$ by the distance P and located from the center line of $R_2$. Thus, as best shown in FIGS. 7 and 8, a larger volume of the seal ring protrudes from the seating surface of the seat at its center than at its sides, so that as the flapper moves from the position of FIG. 6 to that of FIG. 5, the seal ring is compressed more in its central portion than at its end, and a relief in the groove behind the seal ring allows for this.

As also shown, a flange 53 extends inwardly from the inner radially extending side of the groove 50 to form the confining wall 52 on its lower side and to form with the bottom wall 55 of the groove and a recess 54 on its upper side. The seal ring 51, on the other hand, has a recess 56 formed in its inner radially extending side for fitting over the flange to retain the ring in the groove.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A subsurface tubing safety valve, comprising a tubular body connectible as part of a tubing string suspended within a well bore and including a seat on one end having a cylindrical seating surface whose axis extends through and is substantially perpendicular to the axis of the bore, a flapper pivotally mounted in the bore of the body for swinging between an open position to one side of the bore and a closed position in which a cylindrical seating surface on its upper side conforms to the cylindrical seating surface on the seat, means yieldably urging the flapper to closed position, remotely operable means for moving the flapper to open position, and means for sealing between the seating surfaces including a groove about the seat and a ring of elastomeric material retained within the groove and having a lip which protrudes from the seating surface of the seat for engagement by the seating surface of the flapper in order to radially compress the portion of the ring intermediate the lip and an inner wall of the groove prior to engagement of the seating surface of the flapper with the seating surface of the seat, said compressible ring portion being of essentially constant radial thickness throughout its circumference.

2. A valve of the character defined in claim 1, wherein the inner wall of the groove is formed by a cylindrical surface whose axis also intersects and is perpendicular to the axis of the bore but which has a sufficiently smaller radius than the radius of the seating surface of the seat that the lip is initially engaged by the seating surface of the flapper throughout its entire circumference.

3. A valve of the character defined in claim 2, wherein the body has a flange extending inwardly from the inner side of the groove to form the inner wall thereof on one side and a recess on the other side, and the seal ring has a recess in its inner side which fits over the flange in order to retain the ring in the groove.

4. A valve of the character defined in claim 1, wherein the inner wall of the groove is formed by a cylindrical surface whose axis coincides with the axis of the cylindrical seating surface of the seat but whose radius is less than the radius of the seating surface of the seat by approximately the radial thickness of said portion of the ring of elastomeric material.

* * * * *